United States Patent [19]

Krage

[11] 4,189,629

[45] Feb. 19, 1980

[54] APPARATUS AND METHOD FOR MICROWAVE HEATING IN A KILN

[75] Inventor: Mark K. Krage, Royal Oak, Mich.

[73] Assignee: General Motors Corporation, Detroit, Mich.

[21] Appl. No.: 944,911

[22] Filed: Sep. 22, 1978

[51] Int. Cl.[2] ..... H05B 9/06

[52] U.S. Cl. ..... 219/10.55 A

[58] Field of Search ..... 219/10.55 A, 10.55 B, 219/10.55 R, 10.55 F, 10.55 D; 34/1, 4, 17, 164

[56] References Cited

U.S. PATENT DOCUMENTS

| | | | |
|---|---|---|---|
| 3,277,580 | 10/1966 | Tooby | 219/10.55 A |
| 3,549,848 | 12/1970 | Williams | 219/10.55 A |
| 3,614,365 | 10/1971 | Lane | 219/10.55 A |
| 4,045,638 | 8/1977 | Chiang et al. | 219/10.55 A |
| 4,152,567 | 5/1979 | Mayfield | 219/10.55 R |

*Primary Examiner*—Arthur T. Grimley
*Attorney, Agent, or Firm*—R. L. Phillips

[57] ABSTRACT

Apparatus and method for microwave heating and heat recovery in a kiln wherein substances are successively exposed to microwaves to successively raise their temperature and are also successively passed in close proximity to each other to effect radiant heat transfer therebetween for more efficient heating of the substances while the substance from which heat is being transferred is shielded from further exposure to the microwaves to limit the electrical energy usage.

7 Claims, 2 Drawing Figures

APPARATUS AND METHOD FOR MICROWAVE HEATING IN A KILN

This invention relates to apparatus and method for microwave heating in a kiln and more particularly to such apparatus and method wherein there is provided heat recovery without microwave reheating of the heated substances.

In prior known kilns that are gas or electric resistance heated, the heating time required to obtain a certain temperature is very long as compared with that possible with microwave heating of certain substances, and the recovery of heat has limited feasibility because of the low efficiency and high capital cost of conventional recirculating heat recovery systems. However, electric resistance heating is less expensive than microwave heating for maintaining a constant temperature over a prolonged period of time while the much higher cost of electrical energy as compared with gas has thus far substantially offset the faster heating advantage of microwave heating.

According to the present invention there is provided apparatus and method for microwave heating in a kiln that can be cost comparable with presently known gas or electrical resistance heated kilns. This is very simply accomplished by successively exposing the substances for a limited period of time to a source of microwaves to effect the heating thereof and thereafter screening the heated substances from the microwaves to prevent continued heating thereby while permitting the heat radiated therefrom to flow to the following substances being exposed to the microwaves to contribute to the heating thereof. This method may be employed to effect heating of just a small number of substances or articles and is also adaptable to an assembly line operation for heating large numbers thereof.

For such assembly line operation, several kiln arrangements are possible, one being to provide a single successive conveyance of the substances to be heated through the kiln and another being to provide two separate continuous conveyances thereof. In both cases, a microwave screen or barrier arrangement is employed to separate the interior of the kiln into a heating zone that traps the microwaves and a heat recovery zone that is screened or shielded from the microwaves but from which heat can flow to the heating zone. The substances to be heated are conveyed successively in the kiln between an inlet and outlet through the heating zone and then through the heat recovery zone. As a result, the substances are heated as they pass through the heating zone by the microwaves and also by the heat radiated by the heated substances passing through the heat recovery zone and preferrably by counterflow heat transfer while the microwaves are substantially prevented from reheating the heated substances in the heat recovery zone.

The apparatus and method of the present invention is particularly useful, for example, in high volume sintering of ceramic motor pole pieces of barium ferrite which is a material readily heatable with microwaves. Typically, such ceramic motor pole pieces have been heated in gas fired kilns and in one particular instance required about 17 hours of heating time to reach their sintering temperature and about three hours of controlled cooling in the kiln to prevent their cracking. Using the present invention, it is projected that the heating time for sintering of these ceramic motor pole pieces can be reduced to only about three to four hours while the cooling time remains substantially the same and with an electrical energy consumption reduced because of the heat recovery by 30 to 70% as compared with known microwave heating systems. Another advantage is that with both the heat recovery and the microwave screening of the previously heated substances, the kiln can be made substantially smaller as compared with conventional kilns of the gas or electric resistance heated type of equivalent heating capacity.

An object of the present invention is to provide a new and improved apparatus and method of microwave heating.

Another object is to provide apparatus and method for reducing the amount of microwave energy required to heat substances to a desired temperature.

Another object is to provide apparatus and method for microwave heating in a kiln wherein heat is recovered from the heated substances to assist initial microwave heating thereof and wherein the microwaves are substantially prevented from reheating the substances during the heat recovery.

Another object is to provide apparatus and method for heating substances with microwaves and heat recovery wherein the substances are successively exposed for a limited period of time to the microwaves to effect heating thereof and wherein the heated substances are thereafter screened from the microwaves to prevent continued heating thereby while the heat radiated therefrom is directed to flow to following substances being exposed to the microwaves to contribute to the heating thereof.

Another object is to provide apparatus and method for successively heating a series of substances using microwaves and heat recovery by passing the substances through a kiln wherein they are successively exposed for a limited period of time to the microwaves to effect heating thereof and wherein the heated substances are thereafter screened from the microwaves to prevent continued heating thereby while the heat radiated therefrom is directed to flow in counterflow heat relation to following substances being exposed to the microwaves to contribute to the heating thereof.

Another object is to provide a microwave kiln substantially compacted in size by the use of heat recovery wherein heated substances are shielded from the microwaves during heat transfer therefrom.

These and other objects and advantages of the present invention will be more apparent from the following description and drawing in which.

Figure 1:
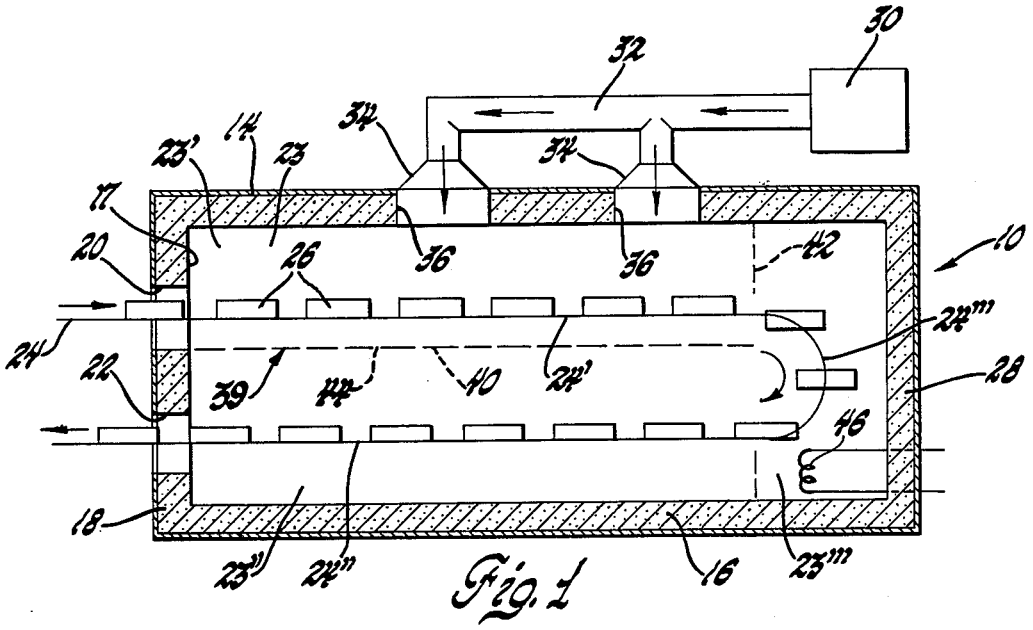
FIG. 1 is a schematic in elevation of apparatus and method for microwave heating of substances in a kiln according to the present invention.

Referring to FIG. 1, there is illustrated a microwave kiln 10 comprising an insulated housing having an outer wall 14 of metal and a thicker inner wall 16 of heat insulating material with a microwave reflecting inner surface 17. At one end 18 of the kiln, there is provided two openings 20 and 22 to the kiln's insulated interior 23. The opening 20 is elevated above the other opening 22 and provides an inlet through which substances to be heated are passed into the kiln while the lower opening 22 provides an outlet by which the substances after being heated may be passed out of the kiln.

The substances to be heated are passed through the kiln by an endless conveyor 24 in receptacles 26 which are spaced along and are carried by the conveyor as it moves in the direction indicated by the arrows. The conveyor 24 extends through the inlet 20 and along the length of the insulated interior 23 at a constant elevation on a track section 24'. As the conveyor approaches the other kiln end 28, it turns 180° and returns at a lower elevation along a track section 24'' and out through the outlet 22, the conveyor being of the ferris wheel type which operates to maintain the receptacles 26 in a horizontal position at the turn around 24'''.

Microwave heating in the kiln is provided by a microwave source 30 from which microwaves are directed by a waveguide 32 and a pair of antenna 34 and through openings 36 in the roof of the kiln to the interior 23 above the elevated conveyor section 24'. However, microwave transmission and thus heating is limited in the kiln by a microwave screen or barrier arrangement 39 comprising a horizontal section 40 and a vertical section 42 of microwave reflecting material. The horizontal section 40 extends horizontally across the kiln interior 23 between the conveyor track sections 24' and 24'' and the vertical section 42 extends vertically across the kiln interior at the conveyor turn around so as to separate the interior 23 into a heating zone 23' surrounding the upper conveyor track section 24' which is open to the microwave transmission and a heat recovery zone 24'' surrounding the lower conveyor track section 24'' which is shielded from the microwave transmission.

The microwave screen 39 has openings 44 therethrough sufficiently smaller than the length of the microwaves so as to substantially prevent their transmission but permit substantial air flow therethrough and thus the microwaves are trapped in the heating zone 23' while the heat recovery zone 23'' is screened or shielded from the microwaves but from which heat can flow through the screen to the heating zone 23'.

Thus as substances are successively transported by the conveyor 24 in the receptacles 26 along the upper track section 24' through the heating zone 23' after entering through the inlet 20, the microwaves trapped therein act to heat the moving substances as they move along the length thereof progressively raising their temperature as they proceed toward the turn around 24'''. Then as the microwave heated substances are turned around and conveyed toward the outlet 22 along the lower track section 24'' through the heat recovery zone 23'', the substances successively cool with the heat radiated therefrom being permitted by the microwave screen to pass upward into the heating zone 23' in counterflow heat relation to assist the microwave energy in the heating of the following substances then passing through the heating zone. Eventually, the system stabilizes and the conveyor speed is adjusted so that the substances remain in the heating zone for a limited period of time sufficient to establish the required temperature with the articles then being heated to the desired temperature in the heating zone 23' by the microwaves and also by the heat radiated from the heated articles in the heat recovery zone 23'' while the microwaves are substantially prevented from reheating the heated articles in the heat recovery zone.

Thus, the heated substances are utilized while cooling as they move to leave the kiln to provide heat in counterflow heat transfer relation in addition to the microwave heating to thereby substantially enhance the economy of operation in the use of microwave heating while taking advantage of its rapid heating characteristics as compared with gas or electric resistance heated kilns. Furthermore, the rate of heat recovery can be adjusted at any point in the kiln by simply adjusting the proximity or providing insulation between the incoming and outgoing substances and can be further controlled by forced air circulation within the kiln.

In addition, there may be provided a heat soak region in the kiln such as for the sintering of an article and for that purpose there is installed an electric resistance heater 46 in a third heating zone 23''' formed by the vertical screen 42 to surround the conveyor at its turn around 24'''. The electric resistance heater 46 is preferred over the use of microwave heating for this particular application in that the rapid heating characteristics of microwave heating are not required at the peak sintering temperature and because electric resistance heating is less expensive for maintaining a constant temperature over a prolonged period of time.

Figure 2:
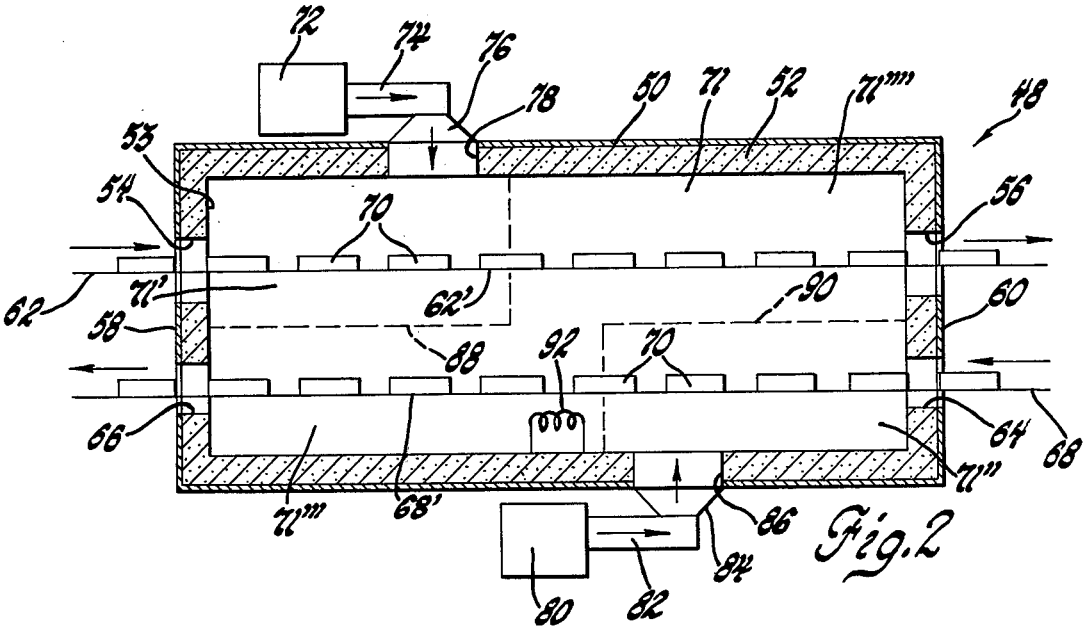
FIG. 2 is a schematic in elevation of another embodiment of apparatus and method for microwave heating of substances in a kiln according to the present invention.

The kiln in FIG. 1 may be described as a single ended kiln in that the substances to be heated are delivered to and received from the same end thereof which provides for a very compact kiln arrangement. It is also contemplated that the kiln may be dual ended and provide for the heating of substances on two or more separate conveyors running in opposite or counterflow directions as shown in FIG. 2. In the FIG. 2 arrangement, the kiln 48 similarly has an outer wall 50 of metal and an inner wall 52 of insulating material with an inner microwave reflecting in surface 53. In this case, there is provided aligned inlet and outlet openings 54 and 56 in opposite ends 58 and 60 of the kiln with an endless conveyor 62 extending through and across the insulated interior 71 on a straight horizontal track 62'. Similarly, except in the directional sense and at a lower elevation, there is provided aligned inlet and outlet openings 64 and 66 in the kiln ends 60 and 58 respectively through which a second conveyor 68 extends and across the insulated interior 71 on a straight horizontal track 68' below the other conveyor. The conveyors 62 and 68 move in opposite directions as indicated by the arrows and both have receptacles 70 in which substances to be heated are carried through the kiln.

In this case, there are provided two separate microwave heating arrangements, one comprising a microwave source 72 from which microwaves are conducted by a waveguide 74 and an antenna 76 and through an opening 78 in the roof of the kiln to the kiln interior 71 adjacent the upper inlet 54. The other microwave arrangement comprises a microwave source 80 from which microwaves are guided by a wave guide 82 and an antenna 84 and through an opening 86 in the floor of the kiln to the kiln interior adjacent the lower inlet 64. The insulated interior 71 is separated by a microwave screen or barrier arrangement 88 and 90 into two heating zones 71' and 71'' and two heat recovery zones 71''' and 71'''' which extend along the respective heating zones 71' and 71''. The two heating zones 71' and 71'' receive and trap the microwaves transmitted through the respective openings 78 and 86 and surround the respective conveyors 62 and 68 from the respective inlets 54 and 64 to a point about midway the length of the kiln. The two heat recovery zones 71''' and 71'''' are screened from the microwaves but permit heat to flow therefrom to the adjoining heating zones 71' and 71'' and surround the respective conveyors 68 and 62 from the respective outlets 66 and 56 to the respective heating zones 71'' and 71'. In addition, for sintering there is installed an electric resistance heater 92 to provide for heat soaking between the exits of the two heating zones and the entrances to the two heating recovery zones.

Thus in the FIG. 2 arrangement and with the conveyors 62 and 68 moving in opposite directions, the microwaves are used to heat the substances in the receptacles 70 after they enter the respective openings 54 and 64 and as they pass through the heating zones 71' and 71''. Thereafter, the heated substances are transported by the conveyors 62 and 68 through the respective heat recovery zones 71''' and 71'''' and heat radiated from the outgoing substances on the conveyors passes through the screens 88 and 90 to aid the microwaves in heating the incoming substances on the conveyors.

The rate of heat recovery can also be adjusted at any point in the dual ended kiln by adjusting the proximity or providing insulation between the incoming and outgoing substances on the two conveyors and that the rate of heat recovery can also be controlled by providing forced air circulation within the kiln. In addition, it will also be understood that a larger microwave source could be used in lieu of the two separate ones shown with a single waveguide having a separate antenna attached to each of the heating zones.

In addition, advantage is taken of a vertical arrangement of the outgoing substances below the incoming substances for the natural upward flow of heat from the single heat recovery zone in the FIG. 1 embodiment and from one of the two heat recovery zones in the FIG. 2 embodiment. For increased heat transfer in the FIG. 2 arrangement, forced downward circulation of the radiated heat from the heat recovery zone 71'''' to the heating zone 71'' below may be employed. But it is also contemplated that the conveyor system rather than providing vertical orientation for the radiant heat transfer may also be horizontally arranged and in that case forced air circulation would be employed for uniformity and and efficiency of heat transfer.

The above described embodiments are illustrative of the invention which may be modified within the scope of the appended claims.

The embodiments of the invention in which an exclusive property or privilege is claimed are defined as follows:

1. A microwave kiln comprising a housing having an insulated interior with at least one inlet and outlet opening thereto, microwave means for supplying microwaves to said interior, microwave screen means for separating said interior into a heating zone that traps the microwaves and a heat recovery zone that is screened from the microwaves but from which heat can flow to said heating zone, and conveyor means for successively conveying two or more substances to be heated from said inlet through said heating zone and then through said heat recovery zone to said outlet whereby at least one of the substances is heated in the heating zone by the microwaves and also by the heat radiated by at least another one of the heated substances as it passes through the heat recovery zone while the microwaves are substantially prevented from reheating the heated substances as they pass through the heat recovery zone.

2. A microwave kiln comprising a housing having an insulated interior with at an inlet and outlet opening thereto in one end thereof, microwave means for supplying microwaves to said interior, microwave screen means for separating said interior into a heating zone that traps the microwaves and a heat recovery zone that is screened from the microwaves but from which heat can flow to said heating zone, and conveyor means for successively conveying a multitude of substances to be heated from said inlet through said heating zone and then through said heat recovery zone and past said heating zone to said outlet whereby the substances are heated in the heating zone by the microwaves and also by the heat radiated by the heated substances in the heat recovery zone while the microwaves are substantially prevented from reheating the heated substances as they pass through the heat recovery zone.

3. A microwave kiln comprising a housing having an insulated interior with an inlet and outlet opening thereto in opposite ends thereof, microwave means for supplying microwaves to said interior, microwave screen means for separating said interior into a pair of heating zones that trap the microwaves and a pair of heat recovery zones that are screened from the microwaves but from which heat can flow to said heating zones, first conveyor means for successively conveying a multitude of substances to be heated from the inlet at one of the ends through one of said heating zones and past one of said heat recovery zones and then through the other heat recovery zone and past the other heating zone to the outlet at the other end, and second conveyor means for successively conveying a plurality of substances to be heated from the inlet at said other end through said other heating zone and past said other heat recovery zone and then through said one heat recovery zone and past said one heating zone to the outlet at said one end whereby the substances are heated in the heating zones by the microwaves and also by the heat radiated by the heated substances passing through the adjoining heat recovery zones while the microwaves are substantially prevented from reheating the heated substances as they pass through the heat recovery zones.

4. A method for heating two or more substances using microwave heating and heat recovery comprising the steps of:

successively exposing the substances to microwaves to successively increase their temperature, passing the substances in close proximity to each other to effect rediant heat transfer therebetween, and limiting the exposure of the microwaves to the substance from which heat is flowing during the heat transfer.

5. A method for heating a multitude of substances using microwave heating and heat recovery comprising the steps of:

successively exposing the substances to microwaves to successively increase their temperature, passing the substances in close proximity to each other to effect counterflow radiant heat transfer therebetween, and limiting the exposure of the microwaves to the substance from which heat is flowing during the heat transfer.

6. A method for heating a multitude of substances in a kiln using microwave heating and heat recovery comprising the steps of:

successively exposing the substances to microwaves to successively increase their temperature, passing the substances in close proximity to each other to effect radiant heat transfer therebetween, and preventing exposure of the microwaves to the substance from which heat is flowing during the heat transfer.

7. A method for heating a multitude of substances in a kiln using microwave heating and heat recovery comprising the steps of:

successively passing the substances into and out of the kiln while exposing the substances to microwaves to successively increase their temperature, passing the outgoing substances in close proximity to the incoming substances to effect radiant counterflow heat transfer therebetween, and limiting the exposure of the microwaves to the substances from which heat is flowing during the heat transfer.

* * * * *